US011673105B2

(12) United States Patent
Huang

(10) Patent No.: US 11,673,105 B2
(45) Date of Patent: Jun. 13, 2023

(54) STIRRING DEVICE

(71) Applicant: Kuo-Chang Huang, Tainan (TW)

(72) Inventor: Kuo-Chang Huang, Tainan (TW)

( * ) Notice: Subject to any disclaimer, the term of this patent is extended or adjusted under 35 U.S.C. 154(b) by 283 days.

(21) Appl. No.: 16/181,985

(22) Filed: Nov. 6, 2018

(65) Prior Publication Data

US 2019/0134577 A1 May 9, 2019

(30) Foreign Application Priority Data

Nov. 8, 2017 (TW) ..... 106138635

(51) Int. Cl.

| | |
|---|---|
| ***B01F 27/55*** | (2022.01) |
| ***B01F 27/1132*** | (2022.01) |
| ***E02F 5/00*** | (2006.01) |
| ***B01F 23/53*** | (2022.01) |
| ***B01F 27/25*** | (2022.01) |
| ***B01F 27/113*** | (2022.01) |
| ***B01F 27/192*** | (2022.01) |
| ***B01F 33/501*** | (2022.01) |

(52) U.S. Cl.

CPC ..... *B01F 27/1132* (2022.01); *B01F 23/53* (2022.01); *B01F 27/113* (2022.01); *B01F 27/192* (2022.01); *B01F 27/25* (2022.01); *B01F 27/55* (2022.01); *B01F 33/5013* (2022.01); *E02F 5/006* (2013.01)

(58) Field of Classification Search

CPC ..... B01F 15/005; B01F 27/55
USPC ..... 366/280, 345; 175/107
See application file for complete search history.

(56) References Cited

U.S. PATENT DOCUMENTS

| | | | | | |
|---|---|---|---|---|---|
| 469,840 | A * | 3/1892 | McDougall | E21B 25/18 | 175/6 |
| 469,841 | A * | 3/1892 | McDougall | E02F 3/9231 | 37/330 |
| 721,973 | A * | 3/1903 | Smith | B01F 7/00991 | 366/280 |
| 1,432,592 | A * | 10/1922 | Catini | A47J 43/09 | 366/155.1 |
| 3,939,073 | A * | 2/1976 | Bats | B01F 5/0619 | 210/219 |
| 4,838,703 | A * | 6/1989 | McMaster | B01F 5/0451 | 137/898 |
| 5,085,810 | A * | 2/1992 | Burrows | B01F 3/04531 | 261/140.1 |

* cited by examiner

*Primary Examiner* — David L Sorkin
(74) *Attorney, Agent, or Firm* — Muncy, Geissler, Olds & Lowe, P.C.

(57) ABSTRACT

A stirring device is adapted to be used for a water storage system. The stirring device includes a tube unit and a stirring unit. The tube unit includes a rigid tube member, and a flexible tube member adapted for interconnecting the rigid tube member and an inlet of the water storage system. The stirring unit includes a center rod extending rotatably into the rigid tube member along an longitudinal direction of the rigid tube member, a support subunit positioning the center rod within the rigid tube member, a driver fan subunit mounted to the center rod and adapted to be driven by water for actuating rotation of the center rod, and a stirring member mounted co-rotatably to the center rod and adapted for stirring sediments in the water.

9 Claims, 5 Drawing Sheets

STIRRING DEVICE

CROSS-REFERENCE TO RELATED APPLICATION

This application claims priority of Taiwanese Patent Application No. 106138635, filed on Nov. 8, 2017.

FIELD

The disclosure relates to a stirring device, and more particularly to a stirring device that facilitates dredging.

BACKGROUND

Referring to FIG. 1, a conventional stirring device 11 is adapted to be used with a water storage system 12. The water storage system 12 includes a dam body 122 defining a water storage space 121, and a dredging tube 123 embedded in the dam body 122. The water storage space 121 houses water 13 with sediments 14 deposited therein. The dredging tube 123 has two water inlets 124 and a water outlet (not shown) that is lower in altitude than the water inlets 124 and that is disposed outside of the water storage system 12. In such a manner, the water 13, the sediments 14, and a mixture thereof are allowed to enter the dredging tube 123 and to be discharged out of the water storage system 12. The stirring device 11 includes a driver unit 111 that floats on the surface of the water 13, and a fan unit 112 that descends to the bottom of the water storage space 121.

Whether at high water level or low water level, the water storage system 12 can perform dredging by discharging the water 13 entrained with the sediments 14 from the dredging tube 123. The fan unit 112 of the stirring device 11 can agitate the water 13 and the sediments 14 in the water storage space 121 to facilitate the removal of the sediments 14. However, the driver unit 111 needs additional power supply to drive the fan unit 112, and cannot function spontaneously relying solely on the hydraulic pressure induced by the water level difference. In addition, the dredging tube 123 cannot move freely in the water 13, thereby resulting in a relatively low dredging efficiency.

SUMMARY

Therefore, an object of the disclosure is to provide a stirring device that can alleviate at least one of the drawbacks of the prior art.

Accordingly, the stirring device is adapted to be used for a water storage system. The water storage system houses water with sediments deposited therein, and has an inlet that is disposed inside the water storage system for fluid flow therethrough. The stirring device includes a tube unit and a stirring unit. The tube unit includes a rigid tube member, and a flexible tube member adapted for interconnecting the rigid tube member and the inlet of the water storage system, such that the water flows into the flexible tube member via the rigid tube member, and flows eventually through the inlet. The stirring unit includes a center rod extending rotatably into the rigid tube member along an longitudinal direction of the rigid tube member, a support subunit positioning the center rod within the rigid tube member, a driver fan subunit mounted to the center rod and adapted to be driven by the water for actuating rotation of the center rod, and a stirring member mounted co-rotatably to the center rod and adapted for stirring the sediments in the water.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
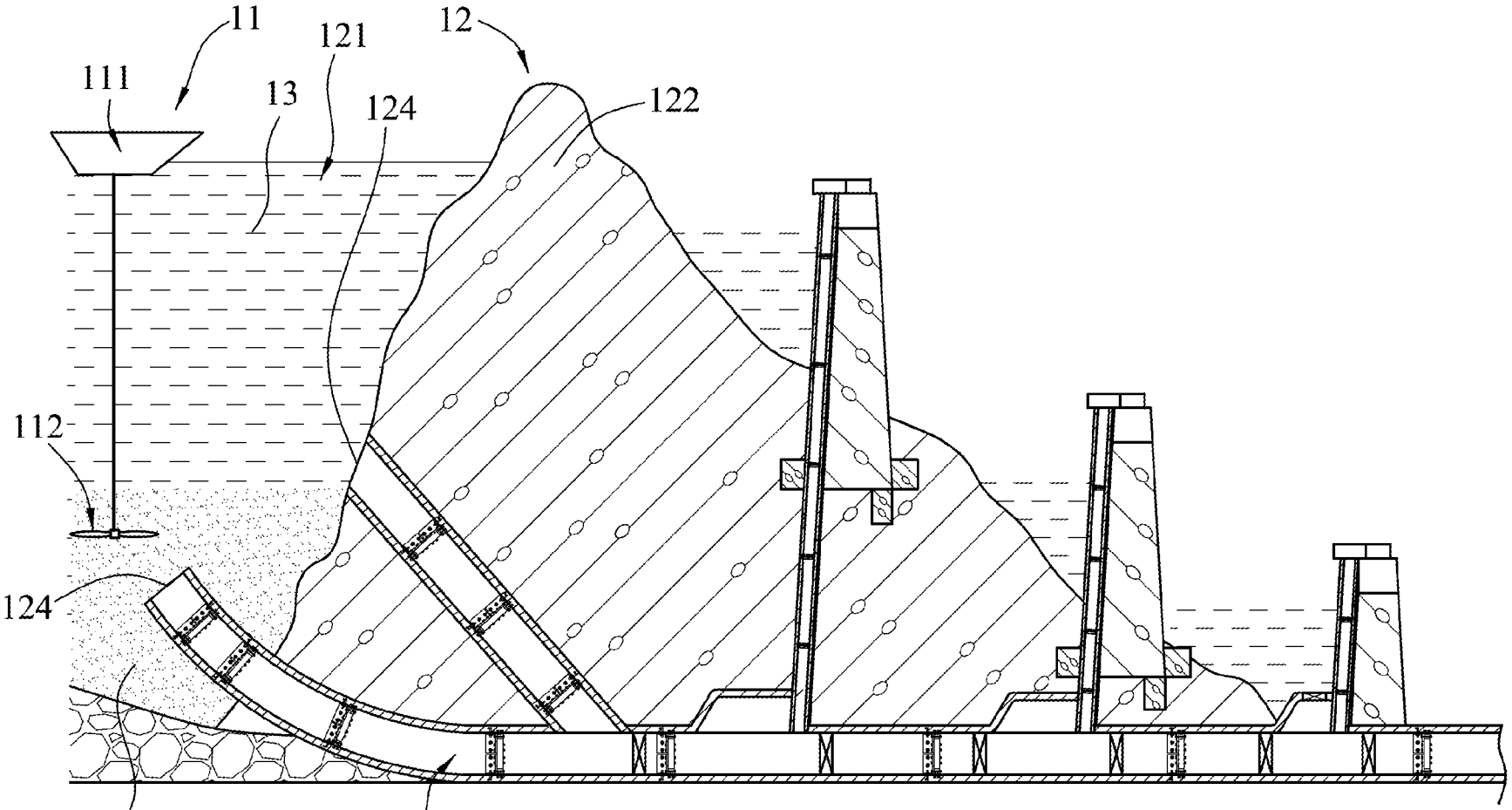
FIG.1 PRIOR ART
FIG. 1 is a sectional view of a conventional stirring device.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
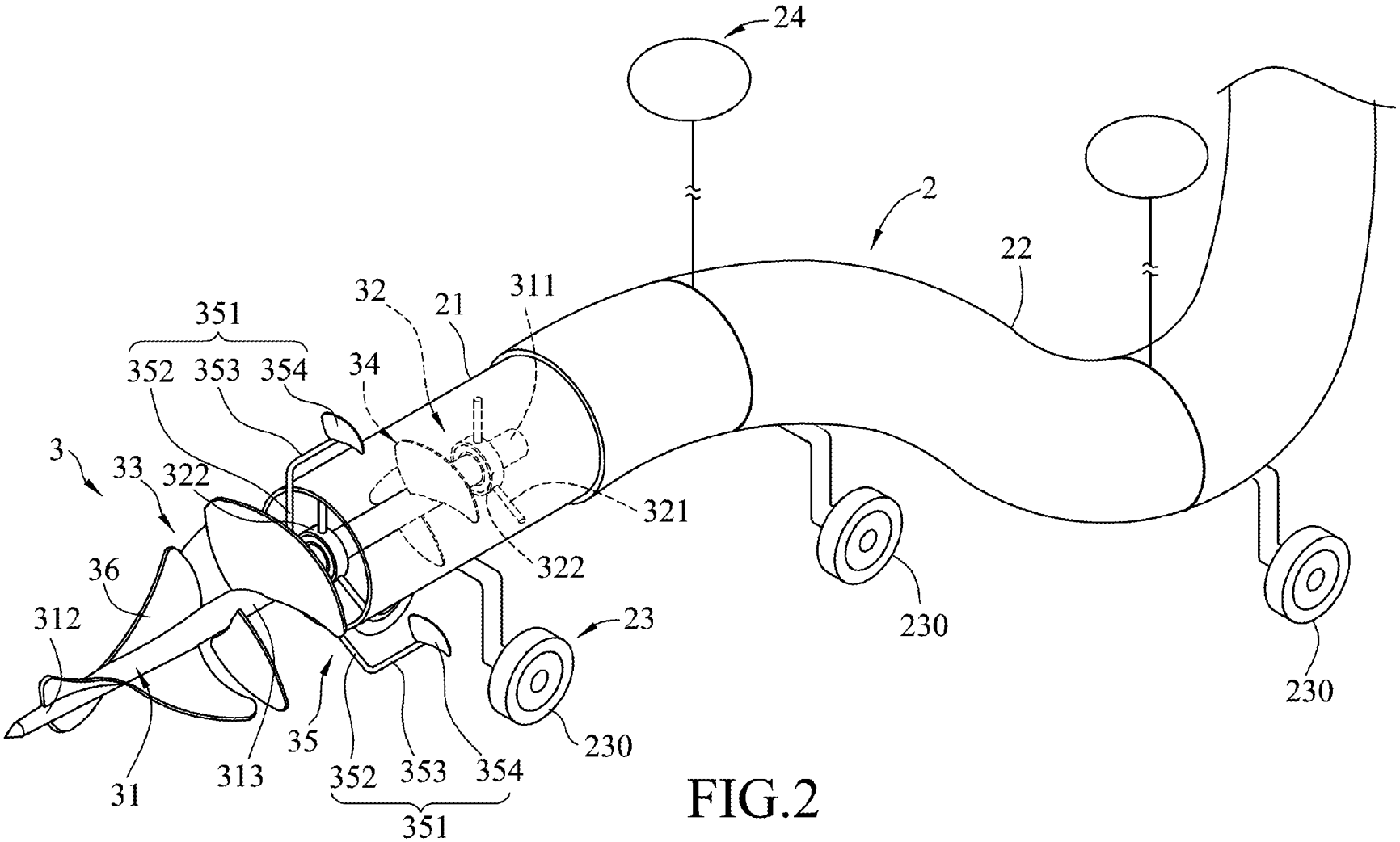
FIG. 2 is a fragmentary perspective view of a first embodiment of the stirring device according to the disclosure.
Figure 3:
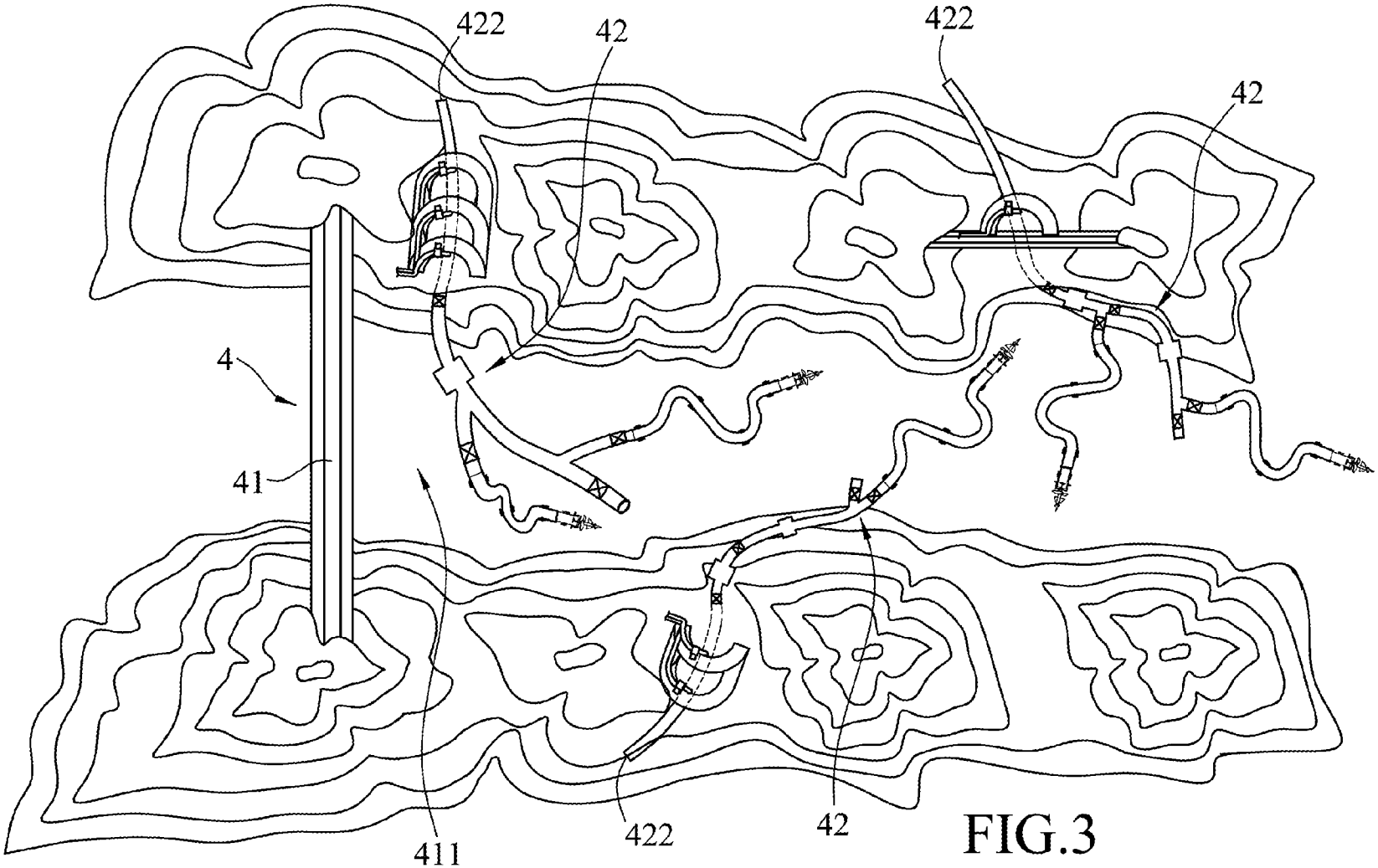
FIG. 3 is a fragmentary top view of a plurality of the first embodiments applied in a water storage system.
Figure 4:
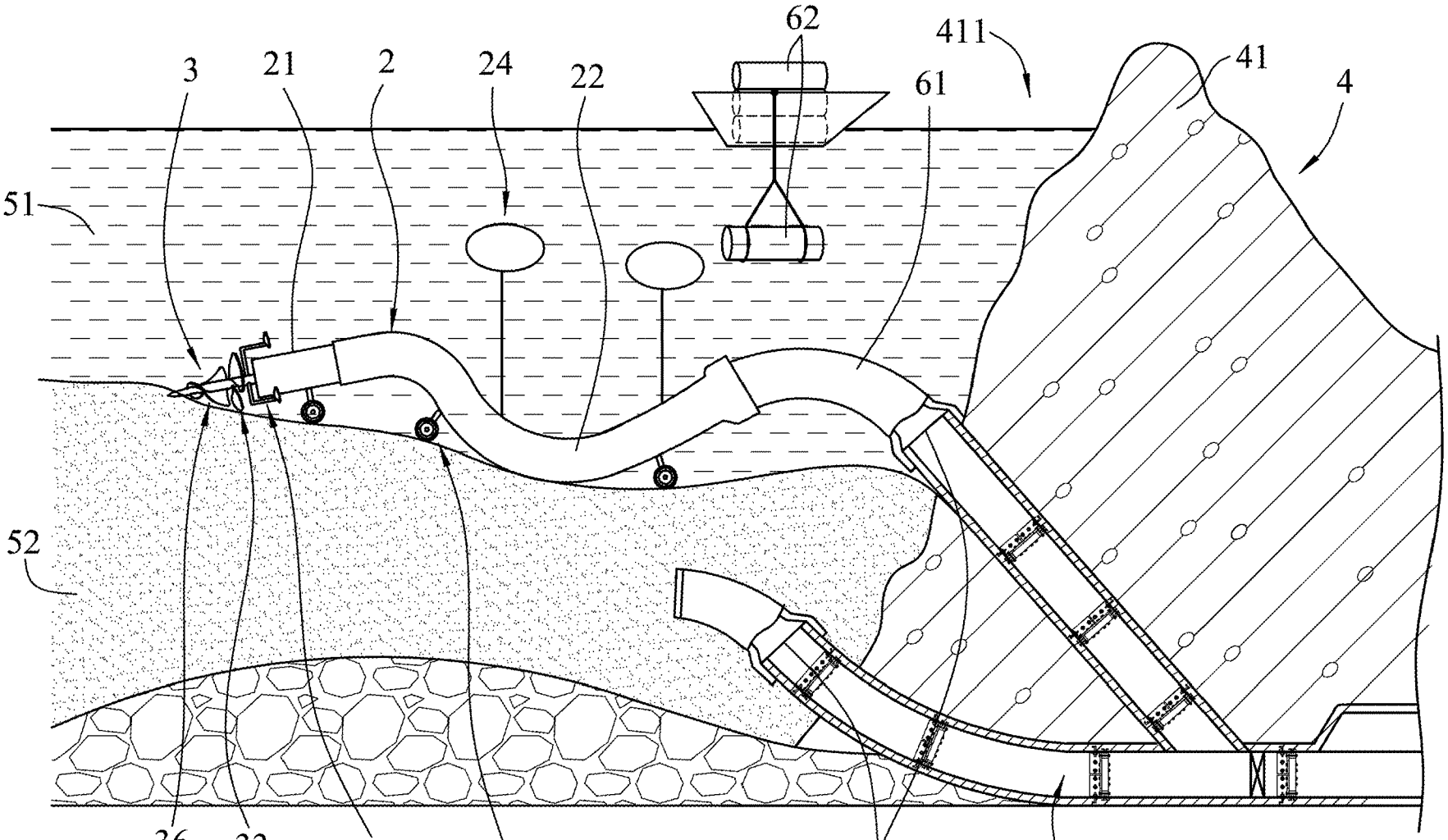
FIG. 4 is a fragmentary partly sectional view of the water storage system and one of the first embodiments.

Referring to FIGS. 2, 3 and 4, the first embodiment of the stirring device according to the present disclosure includes a tube unit 2 and a stirring unit 3.

The tube unit 2 includes a rigid tube member 21, a flexible tube member 22 connected to and in fluid communication with the rigid tube member 21, a mobility subunit 23 disposed at outer bottom portions of both the rigid tube member 21 and the flexible tube member 22, and a buoy set 24 connected to a top end of the flexible tube member 22.

Specifically, the rigid tube member 21 is cylindrical. The flexible tube member 22 is sleeved on a rear end portion of the rigid tube member 21. The mobility subunit 23 includes a plurality of wheels 230 for improving mobility of the tube unit 2.

In this embodiment, the stirring unit 3 includes a center rod 31 extending rotatably into the rigid tube member 21 along an longitudinal direction of the rigid tube member 21, a support subunit 32 positioning the center rod 31 within the rigid tube member 21, a driver fan subunit 33 disposed outside of the rigid tube member 21, mounted to the center rod 31 and adapted to be driven by water for actuating rotation of the center rod 31, an auxiliary fan subunit 34 disposed inside the rigid tube member 21 and mounted to the center rod 31, a propeller fan subunit 35 mounted to the center rod 31 and disposed between the driver fan subunit 33 and the rigid tube member 21, and a stirring member 36 mounted co-rotatably to the center rod 31.

The center rod 31 of the stirring unit 3 has an inner rod portion 311 that is disposed in the rigid tube member 21, an outer rod portion 312 that is disposed outside of the rigid tube member 21, and a middle rod portion 313 that interconnects the inner and outer rod portions 311, 312. The front end of the outer rod portion 312 has a tapered shape.

The support subunit 32 includes two spaced-apart bearings 322 that are disposed in the rigid tube member 21 of the tube unit 2 and that are arranged along the longitudinal direction of the rigid tube member 21. The center rod 31 extends rotatably through the bearings 322. The support subunit 32 further includes two support frames 321 that are disposed in the rigid tube member 21. Each of the support frames 321 includes a plurality of rods extending radially and outwardly from a respective one of the bearings 322 to the rigid tube member 21, and each rod of the support frames 321 has a cross section of a streamlined shape that can reduce water resistance.

The driver fan subunit 33 is mounted to the middle rod portion 313 of the center rod 31. The auxiliary fan subunit 34 is mounted to the inner rod portion 311 of the center rod 31 and is identical in configuration to, but smaller in size than, the driver fan subunit 33, thereby assisting the driver fan subunit 33 for increasing power to actuate the rotation of the center rod 31. In other embodiments of the disclosure, the configuration of the auxiliary fan subunit 34 may be similar to, but not necessarily identical to, that of the driver fan subunit 33 so long as it increases the power for actuating the rotation of the center rod 31.

The propeller fan subunit 35 of the stirring unit 3 has a plurality of angularly spaced-apart propeller members 351. Each of the propeller members 351 has a radial section 352, a longitudinal section 353 and a fan blade section 354. The radial section 352 extends outwardly and radially from the middle rod portion 313 of the center rod 31, and has a length larger than an inner radius of the rigid tube member 21 of the tube unit 2. The longitudinal section 353 extends from the radial section 352 along the longitudinal direction of the rigid tube member 21, and is disposed outside of the rigid tube member 21. The fan blade section 354 is connected to the longitudinal section 353 at an end distal from the radial section 352. Each of the fan blade sections 354 is fin-shaped, which is the same as the blade of the driver fan subunit 33. However, in practical implementation, the shapes of the fan blade sections 354 and the blades of the driver fan subunit 33 may be similar but not necessarily identical. The propeller members 351 are adapted to be driven by water, such that rotation of the propeller tan subunit 35 results in movement of the rigid tube member 21.

The stirring member 36 includes a plurality of spiral blades mounted to the outer rod portion 312 of the center rod 31, and the radial width of each blade gradually increases in a direction toward the middle rod portion 313.

The first embodiment is adapted for use with a connecting tube 61 that interconnects the flexible tube member 22 and a water storage system 4. In the following description, the water storage system. 4 is a reservoir. However, the present embodiment may also be applied to other water storage systems 4 such as a lake or a pond. Since the technique of connecting the first embodiment and the water storage system 4 by the connecting tube 61 is of common knowledge, its related description is omitted herein for the sake of brevity. The water storage system 4 includes a dam body 41 built on a hillside, and a plurality of dredging tubes 42 embedded in the bottom of the dam body 41 and extending in the gradient direction of the hillside. The dam body 41 defines a water storage space 411 that houses water 51 with sediments 52 deposited therein.

For the sake of brevity, the following description refers to only one of the dredging tubes 42. The dredging tube 42 has a plurality of inlets 421 that are in fluid communication with the water storage space 411. The connecting tube 61 interconnects the flexible tube member 22 and the inlet 421 of the dredging tube 42 (i.e., the flexible tube member 22 interconnects the rigid tube member 21 and the inlet 421 via the connecting tube 61), and allows the water 51, the sediments 52, and a fluid mixture of the water 51 and the sediments 52 to flow through the dredging tube 42. The dredging tube 42 further has an outlet 422 (refer to FIG. 3) that is lower in altitude than the inlets 421 and that is disposed outside of the water storage system 4. The structure of the dredging tubes 42 can be referred to Taiwanese Utility Model Patent No. M547570.

When a dredging process occurs in the water storage system 4 due to hydraulic pressure induced by water level difference, a fluid flows into the rigid tube member 21 and the flexible tube member 22, and is discharged through the dredging tube 42. The movement of the fluid actuates the rotations of the driver fan subunit 33 and the auxiliary fan subunit 34, which further drive the center rod 31 and the stirring member 36 to rotate. In such a manner, the sediments 52 are agitated to be fully mixed with the water 51. The sediments 52 and the water 51 then form the fluid mixture which may be easily discharged from the dredging tube 42. The configuration of the stirring member 36 as spiral blades has the advantage of facilitating the stirring and overturning of the sediments 52 and render a better sand blowing effect.

When the fluid drives the driver fan subunit 33 and the auxiliary fan subunit 34, the propeller fan subunit 35 is driven as well to generate a propelling power, which results in the movement of the first embodiment. As a result, the stirring member 36 is able to simultaneously move about and mix the sediments 52 with the water 51. Moreover, the mobility of the mobility subunit 23 and the buoyancy of the buoy set 24, which reduces the weight of the first embodiment, cooperatively facilitate the movement of the first embodiment.

The configuration of the support frames 321 of the support subunit 32 as multiple rods not only provides support of the bearings 322 for facilitating the rotation of the center rod 31, but has the advantage of not obstructing the flow of the fluid into the rigid tube member 21. Each of the rods of the support frames 321 has a streamlined shape which reduces fluid resistance.

As shown in FIG. 3, the first embodiment can be assembled to different ones of the dredging tubes 42, and performs dredging at different locations. It can be seen from FIGS. 3 and 4 that the first embodiment has the advantage of combining the characteristics of the rigid tube member 21 and the flexible tube member 22, that is, the rigid tube member 21 provides sufficient support for the stirring unit 3, and the flexible tube member 22 facilitates the mobility of the rigid tube member 21 for wide range dredging.

Although the first embodiment can function spontaneously due to the hydraulic pressure induced by the water level difference between the inside and the outside of the water storage system 4, a submersible pump (not shown) may be added to act as an auxiliary power supply for driving the center rod 31 and increasing the power of the stirring member 36 to agitate the sediments 52.

When the first embodiment is in use, as shown in FIG. 4, a plurality of extension tubes 62 may be unloaded from a ship and assembled to the first embodiment when the length of the first embodiment is insufficient and hinders the movement of dredging.

Figure 5:
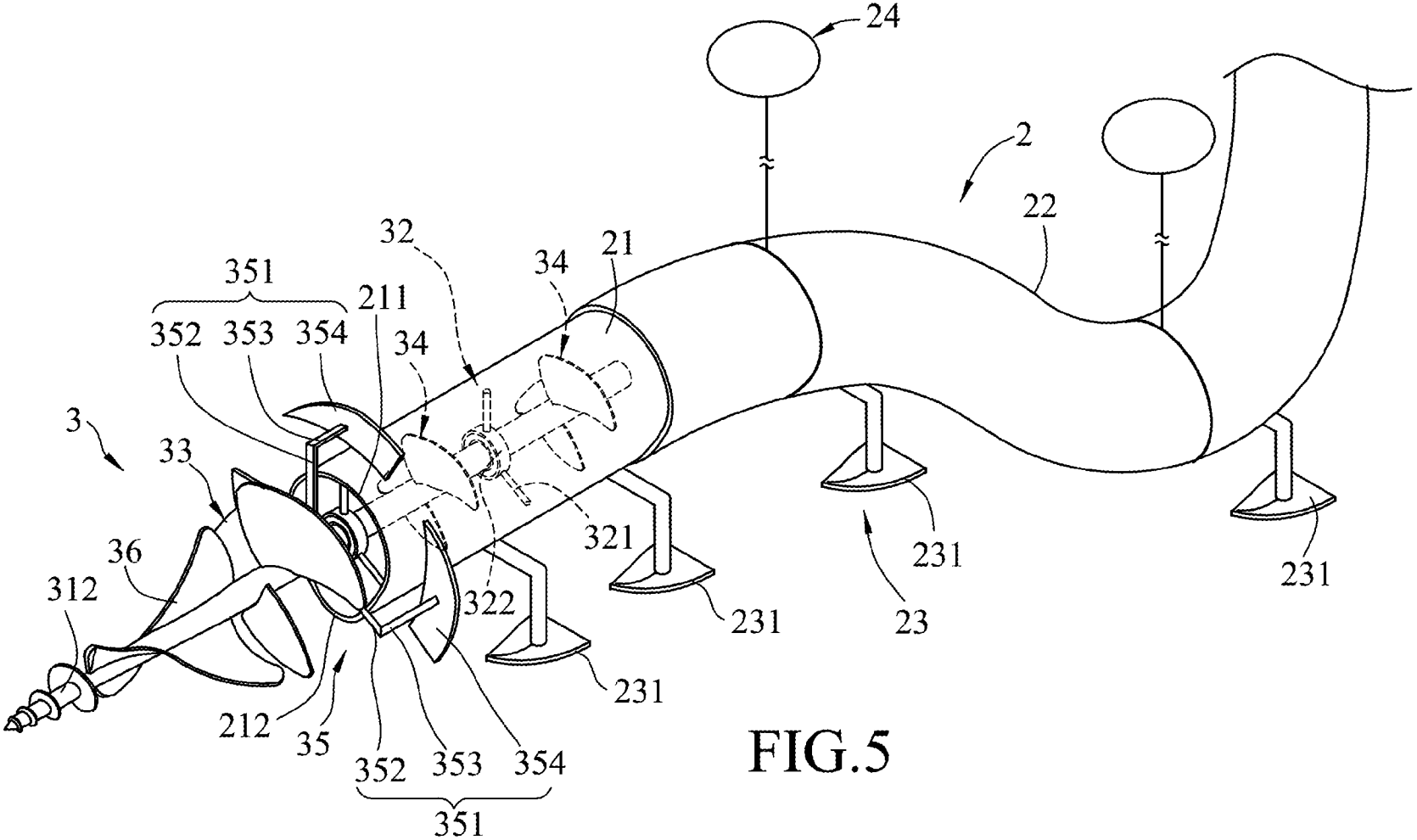
FIG. 5 is a fragmentary perspective view of a second embodiment of the stirring device according to the disclosure.

Referring to FIG. 5, the second embodiment of the disclosure is similar to the first embodiment and the differences therebetween reside in the following.

In this embodiment, the rigid tube member 21 of the tube unit 2 has an upper tube portion 211 and a lower tube portion 212 that is coupled to the upper tube portion 211 along an imaginary plane. A maximum distance between the upper tube portion 211 and the imaginary plane is smaller than that between the lower tube portion 212 and the imaginary plane. The lower tube portion 212 has an uneven inner surface. In other embodiments of the present disclosure, the sedimenttrapping unit disclosed in Taiwanese Utility Model Patent No. M547570 may be added to the rigid tube member 21.

The outer rod portion 312 of the center rod 31 of the stirring unit 3 has a front end segment provided with an external thread. The mobility subunit 23 has a plurality of gliding boards 231 that slidably abut on the sediments 52. The second embodiment is particularly applicable to locations where the sediments 52 have relatively small-sized particles. The shape of the gliding boards 231 can remain on top of the sediments 52 without sinking thereinto.

In this embodiment, the stirring unit 3 further includes two auxiliary fan subunits 34 that are connected to the center rod 31 and that are spaced apart from each other. The fan blade section 354 of each of the propeller members 351 is configured as a sled-shaped board extending annularly relative to an axis of the center rod 31.

Since the upper tube portion 211 and the lower tube portion 212 are not structurally symmetrical, large-sized particles in the sediments are allowed to move in the lower tube portion 212 of the rigid tube member 21 without hitting and damaging the auxiliary fan subunits 34.

In summary, the advantages of the stirring device of the present disclosure lie in that when the fluid is discharged from the water storage system 4 due to the water level difference, the hydraulic pressure induced by the movement of the fluid may actuate the rotation of the center rod 31, such that the present disclosure may move freely in the water storage system, and spontaneously agitates the sediments 52. Therefore, the present disclosure is not only more efficient at dredging but friendly to the environment by reducing energy consumption thereof.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A stirring device for a water storage system, the water storage system housing water with sediments deposited therein, and having an inlet that is disposed inside the water storage system for fluid flow therethrough, said stirring device comprising:

a tube unit comprising:

a rigid tube member, and a flexible tube member adapted for interconnecting said rigid tube member and the inlet of the water storage system, such that the water flows into said flexible tube member via said rigid tube member, and flows eventually through the inlet; and a stirring unit comprising:

a center rod extending rotatably into said rigid tube member along an longitudinal direction of said rigid tube member, a support subunit positioning said center rod within said rigid tube member, a driver fan subunit mounted to said center rod and adapted to be driven by the water for actuating rotation of said center rod, and a stirring member mounted co-rotatably to said center rod and adapted for stirring the sediments in the water;

wherein said center rod of said stirring unit comprises:

an inner rod portion that is disposed in said rigid tube member of said tube unit, an outer rod portion that is disposed outside of said rigid tube member, and a middle rod portion that interconnects said inner and outer rod portions;

wherein said driver fan subunit is mounted to said middle rod portion and is disposed outside of said rigid tube member;

wherein said stirring member is mounted to said outer rod portion; and wherein said stirring unit further comprises a propeller fan subunit that is mounted to said middle rod portion of said center rod, that is disposed between said driver fan subunit and said rigid tube member of said tube unit, and that is adapted to be driven rotatably by the water, such that rotation of said propeller fan subunit results in movement of said rigid tube member of said tube unit.

2. The stirring device as claimed in claim 1, wherein said propeller fan subunit of said stirring unit has a plurality of angularly spaced-apart propeller members, each of said propeller members having:

a radial section that extends outwardly and radially from said middle rod portion of said center rod, and that has a length larger than an inner radius of said rigid tube member of said tube unit;

a longitudinal section that extends from said radial section along the longitudinal direction of said rigid tube member, and that is disposed outside of said rigid tube member; and a fan blade section that is connected to said longitudinal section at an end distal from said radial section.

3. The stirring device as claimed in claim 2, wherein said fan blade section of each of said propeller members is fin-shaped.

4. The stirring device as claimed in claim 2, wherein said fan blade section of each of said propeller members is configured as a sled-shaped board.

5. The stirring device as claimed in claim 3, wherein said tube unit further includes a mobility subunit that is disposed for improving mobility of said tube unit.

6. The stirring device as claimed in claim 1, wherein said stirring unit further includes at least one auxiliary fan subunit that is mounted to said inner rod portion of said center rod, and that is adapted to be driven by the water for facilitating the rotation of said center rod.

7. The stirring device as claimed in claim 1, wherein said support subunit includes:

a plurality of spaced-apart bearings that are disposed in said rigid tube member of said tube unit and that are arranged along the longitudinal direction of said rigid tube member, said center rod extending rotatably through said bearings; and a plurality of support frames that are disposed in said rigid tube member, each of which extends radially and outwardly from a respective one of said bearings to said rigid tube member.

8. The stirring device as claimed in claim 1, wherein said outer rod portion has a front end segment provided with an external thread.

9. The stirring device as claimed in claim 1, wherein said rigid tube member of said tube unit has an upper tube portion and a lower tube portion that is coupled to said upper tube portion along an imaginary plane, a maximum distance between said upper tube portion and the imaginary plane being smaller than that between said lower tube portion and the imaginary plane.

* * * * *